US006106277A

United States Patent [19]

Xie

[11] Patent Number: 6,106,277

[45] Date of Patent: Aug. 22, 2000

[54] SAFETY ARRANGEMENT OF PIEZOELECTRIC UNIT FOR PIEZOELECTRIC LIGHTER

[76] Inventor: Yiling Xie, 10699 Hickson St., #4, El Monte, Calif. 91731

[21] Appl. No.: 09/449,802

[22] Filed: Nov. 26, 1999

[51] Int. Cl.[7] ..... F23D 11/36

[52] U.S. Cl. ..... 431/153; 431/255

[58] Field of Search ..... 431/153, 255

[56] References Cited

U.S. PATENT DOCUMENTS 5,655,901 8/1997 Makoto ..... 431/153

OTHER PUBLICATIONS

European Patent Application 0 291 956, Nov. 1988.

*Primary Examiner*—Carroll Dority

*Attorney, Agent, or Firm*—Raymond Y. Chan; David and Raymond

[57] ABSTRACT

A piezoelectric unit with built-in safety arrangement which is adapted to equipped with all kinds of piezoelectric lighter so as to provide a safety lock feature for the piezoelectric lighter. The piezoelectric unit includes a piezoelectric housing having a lower base body and an upper actuation chamber; an operating member having an axial receiving cavity provided therein and being slidably fitted in the actuation chamber of the piezoelectric housing in a vertically movable manner; a high voltage generating means which is arranged in the base body for generating striking sparks at an ignition tip thereof when the operating member disposed in the actuation chamber is pressed downwardly towards the base body; and a safety arrangement which is arranged in the operating member for normally locking a downward movement of the operating member unless a turner member is operated with the downward movement of the operating member.

24 Claims, 11 Drawing Sheets

SAFETY ARRANGEMENT OF PIEZOELECTRIC UNIT FOR PIEZOELECTRIC LIGHTER

FIELD OF THE PRESENT INVENTION

The present invention relates to piezoelectric lighter, and more particular to a safety arrangement of a piezoelectric unit that can be installed in all kinds of piezoelectric unit so as to provide a childproof safety feature for the piezoelectric lighter. Such safety arrangement not only enables the piezoelectric lighter to prevent the minor, especially under 5 years old, to ignite the lighter so as to guarantee the safety of children, but also can prevent the lighter from being accidentally or unintentionally ignited by the adults.

BACKGROUND OF THE PRESENT INVENTION

Piezoelectric lighter becomes more and more popular because of its convenience and neat appearance. FIG. 1 illustrates a traditional piezoelectric lighter 10 which comprises a casing 11 having a liquefied gas storage 111 and a piezoelectric unit casing 12 provided on top of the liquefied gas storage 111 and defining a pusher cavity 121 therein. A gas ejection nozzle 13 appears from a ceiling 112 of the casing 11 and communicating with the liquefied gas storage 111 for controlling the flow of gas. A piezoelectric unit 20, which is fitted in the piezoelectric unit casing 12, comprises a movable operating part 21 extended through the pusher cavity 121 for generating piezoelectricity, and an ignition tip 301 connected thereto. A thumb-push cap 15 is slidably fitted in the pusher cavity 121 of the casing 11 in a vertically movable manner, wherein a top portion thereof is exposed above the casing 11 and attached to a top head 211 of the piezoelectric unit 20.

The thumb-push cap 15 is operatively connected both to the gas ejecting nozzle 13 and to the piezoelectric unit 20 for striking spark in response to a push to the thumb-push cap 15. A push-down action of the thumb-push cap 15 will downwardly drive and press the piezoelectric unit 20 which will generate striking spark through and out the igniting tip 301 towards a gas ejection tip 131 of the gas ejection nozzle 13 which is simultaneously operated to release gas by a gas rod activator 14. The ejecting gas ejected from the gas ejection nozzle 13 will be ignited by the striking spark emitted from the ignition tip 301.

For protecting the safety and benefit of children, the U.S. Consumer Product Safety Commission imposed an important regulation that "Child below 5 years old cannot light the lighter". Some of the piezoelectric lighters, such as U.S. Pat. Nos. 4,786,248, 4,859,172, 5,240,408, 5,368,473, 5,462,432, and 5,829,963, each provides a switching mechanism or safety lock mechanism for rendering the piezoelectric lighter child resistant. Some switching mechanisms generally provide a switch member in the lighter body that requires the adult user to turn on before permitting an thumb-operated piezoelectric unit to be depressed to lift a gas pipe to open a gas release valve to emit gas and to generate sparks at the same time to ignite the emitted gas. Other switching mechanisms construct a locking switch for blocking the downward movement of the pusher cap so as to lock up the piezoelectric lighter.

However, such conventional piezoelectric lighters with switching mechanism also bear the drawbacks as follows:

1. Some switching mechanisms require the piezoelectric lighter to alter its structure in order to equip with the switch member. Or, numerous of additional elements of the switching mechanism are required to incorporate with the traditional piezoelectric lighter for ensuring the safety feature thereof. Such costly switching mechanism not only increases the cost of the lighter, but also increases the manufacturing procedures of the lighter.

2. If the user forgets to turn off the switch member to its locking position, the piezoelectric lighter is already to ignite by any child. In other words, such switching-type safety piezoelectric lighter can provide safety function if and only if the adult user remembers to operate an additional turning off action to re-lock the switching mechanism of the piezoelectric lighter again. Most users may even intentionally skip this re-locking operation.

3. There are many kinds of piezoelectric lighter, in which each of them contains a specific casing design. In other words, each style of piezoelectric lighter needs a particular design to incorporate a switching mechanism or safety lock. That would be a costly and troublesome burden to all lighter the manufacturer. Every new design of piezoelectric lighter, the engineer needs to redesign a new specific safety mechanism therefore in order to fit the different shape and structure of the new design of the lighter casing. Especially, to those manufacturers who already have many kinds of piezoelectric lighter without safety mechanism, they need to invest a great expense for preparing new molds.

In fact, the conventional switching mechanism of the piezoelectric lighter is a manual lock only but can not be classified as a safety lock because a real safety lighter should normally be locked, that is the piezoelectric lighter should automatically re-lock after each ignition operation, so as to prevent the children from igniting the lighter anytime, or to prevent the lighter from accidentally or unintentionally be ignited by the user.

SUMMARY OF THE PRESENT INVENTION

A main object of the present invention is to provide a piezoelectric unit with built-in safety arrangement, which is adapted to equipped with all kinds of piezoelectric lighter so as to provide a safety lock feature for the piezoelectric lighter.

Another object of the present invention is to provide a safety arrangement of a piezoelectric unit adapted to equip with a piezoelectric lighter, which not only can prevent the minor, especially under 5 years old, to ignite the lighter so as to guarantee the safety of children, but also can normally lock up the piezoelectric unit to prevent the piezoelectric lighter from being accidentally or unintentionally ignited by the adults.

Another object of the present invention is to provide a safety arrangement of a piezoelectric unit for a piezoelectric lighter, which can automatically return to a locking condition after each ignition operation, so as to prevent any lighting operation of the piezoelectric unit by locking up the downward movement of the pusher cap.

Another object of the present invention is to provide a safety arrangement of a piezoelectric unit for a piezoelectric lighter, which does not require to alter the original structural design of the piezoelectric lighter, so as to minimize the manufacturing cost of improving every conventional piezoelectric lighter to have safety feature.

In order to accomplish the above objects, the present invention provides a piezoelectric unit with safety arrangement, which is adapted to be equipped with a piezoelectric lighter such as a cigarette lighter or a barbecue lighter, comprising:

a piezoelectric housing having a lower base body and an upper actuation chamber;

an operating member having an axial receiving cavity provided therein and being slidably fitted in the actuation chamber of the piezoelectric housing in a vertically movable manner;

a high voltage generating means which is arranged in the base body for generating striking sparks at an ignition tip thereof when the operating member is downwardly pressed towards base body in the actuation chamber; and a safety arrangement which is arranged in the operating member for normally locking the downward movement of the operating member until a switch is operated during the downward movement of the operating member.

According to the present invention, the high voltage generating means comprises at least one piezoelectric ceramic which is received in the base body providing a positive terminal and a negative terminal extended to a bottom end of the actuation chamber; a lead wire having one end connected to the positive terminal and forming an ignition tip at another end of the lead wire; a piezoelectric hammer disposed in the receiving cavity of the operating member in a vertically movable manner; a supporting means for normally supporting the operating member and the piezoelectric hammer in a normal position that a distance is retained between the piezoelectric hammer and the negative terminal; and an actuation means for driving the piezoelectric hammer vigorously and instantaneously striking on the negative terminal so as to generate a relatively high voltage between the ignition tip of the lead wire and a gas ejection tip of a lighter to which the piezoelectric unit equipped therewith, so that the striking sparks are generated from the igniting tip and jumped to the gas ejection tip.

DETAILED DESCRIPTION OF THE PREFERRED EMBODIMENT

Figure 1:
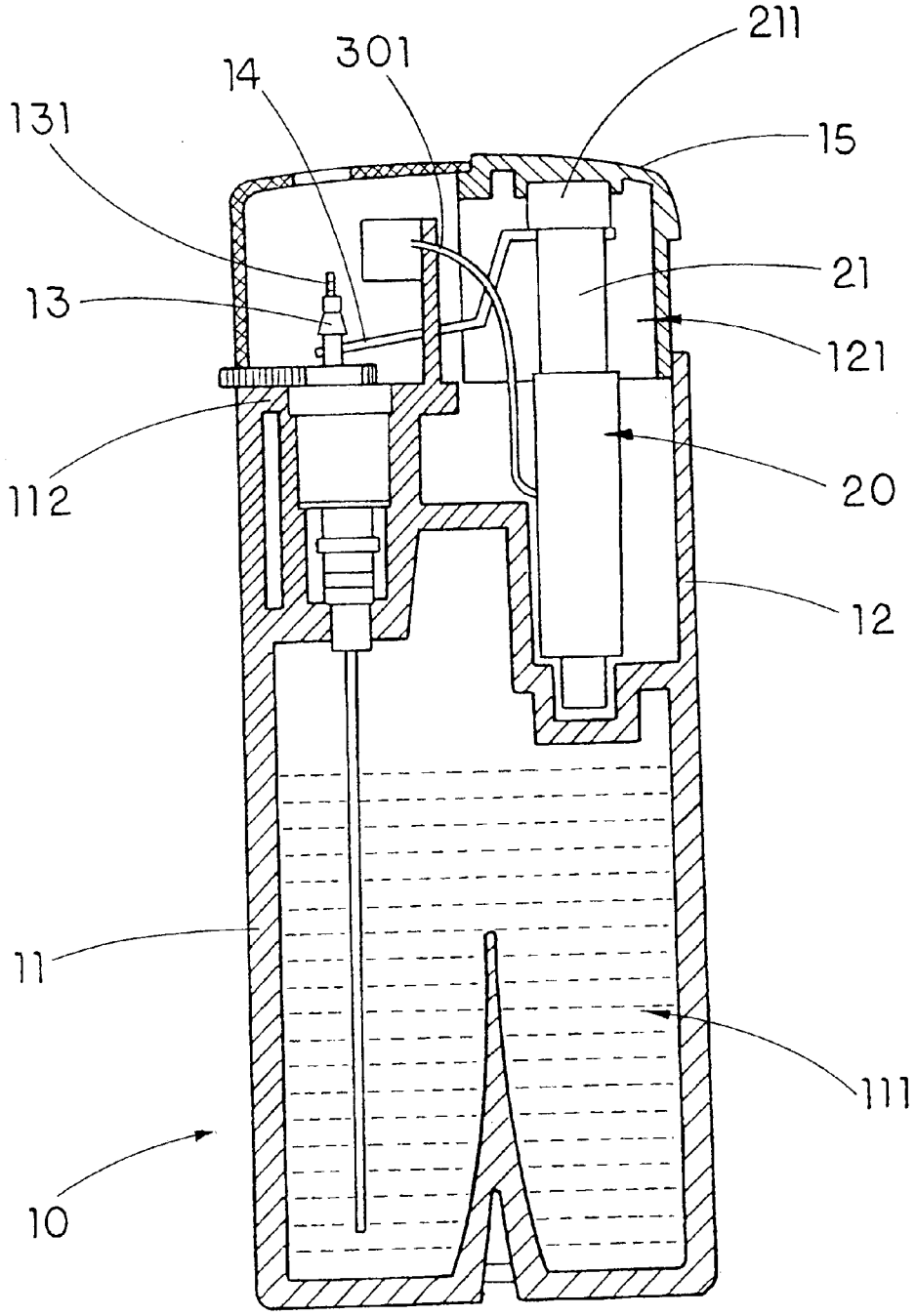
FIG.1 PRIOR ART
FIG. 1 is a sectional view of a conventional piezoelectric lighter.
Figure 2:
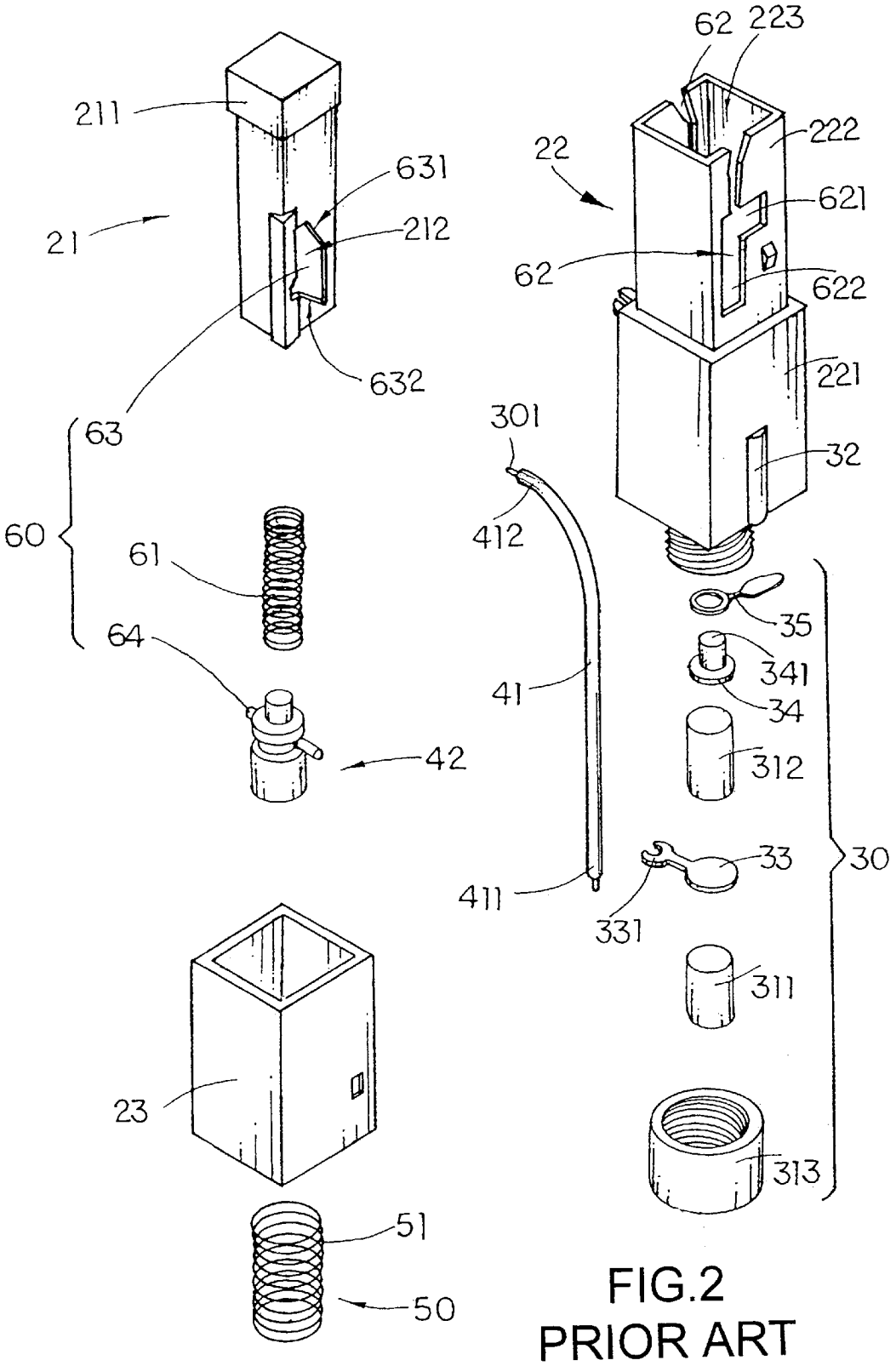
FIG.2 PRIOR ART
FIG. 2 is an exploded perspective view of a conventional piezoelectric unit.

For better understanding of the present invention, a conventional piezoelectric unit 20 is described hereinafter for how it works and functions. As shown in FIGS. 1 and 2, the conventional piezoelectric unit 20 comprises an operating member 21 and a piezoelectric housing 22, and a high voltage generating means 30.

The piezoelectric housing 22 comprises a base body 221 and a tubular actuation body 222 upwardly extended from the base body 221 to define an actuation chamber 223 therein. The operating member 21 has a top head 211 and an axial receiving cavity 212 extended from the top head 211 to an opened bottom end. The operating member 21 is slidably fitted in the actuation chamber 223 of the piezoelectric housing 22 in a vertically movable manner. Moreover, a housing sleeve 23, having a height equal to the actuation body 222, is arranged to surround the actuation body 222 for ensuring the relatively motion of the operating member 21 within the actuation chamber 223 of the actuation body 222.

The high voltage generating means 30, which is arranged in the base body 221 for generating striking sparks at an ignition tip 301 thereof when the operating member 21 is downwardly pressed towards base body 221 in the actuation chamber 223, comprises at least one or mostly a pair of piezoelectric ceramics 311, 312, a lead wire 41, a piezoelectric hammer 42, a supporting means 50, and an actuation means 60.

The piezoelectric ceramics 311, 312 are received in the base body 221 and covered by a metal cover 313 which also electrically connects a negative pole end of the lower piezoelectric ceramic 311 to a conductive bar 32 that is made of copper and attached to the base body 221. An electrical lead washer 33 is positioned between the two positive poles of the two piezoelectric ceramics 311, 312 inside the base body 221 when two piezoelectric ceramics are equipped, so as to provide a positive terminal 331. A strike pin 34 should be disposed and in contact with a top negative pole end of the upper piezoelectric ceramic 312. A top tip of the strike pin 34 forms a negative terminal 341 which is extended to a bottom end of the actuation chamber 223. An electrical connector 35 is connected between the strike pin 34 and the conductive bar 32.

The lead wire 41 has a lower end 411 connected to the positive terminal 331 and an upper end 412 providing the ignition tip 301. As shown in FIG. 1, when the piezoelectric unit 20 installed in the piezoelectric lighter casing 11, the lower end 411 is extended to the piezoelectric unit casing 12 while the ignition tip 301 at the upper end 412 is extended to a position closed to the gas ejection tip 131 of the gas ejection nozzle 13. The piezoelectric hammer 42 is disposed in the receiving cavity 212 of the operating member 22 in a vertically movable manner.

The supporting means 50 is adapted for normally supporting the operating member 21 and the piezoelectric hammer 42 in a normal position that a distance is retained between the piezoelectric hammer 42 and the negative terminal 341. As shown in FIG. 2, the supporting means 50 comprises a supporting spring 51 disposed between the piezoelectric hammer 42 and the base body 221 inside the actuation body 222.

The actuation means 60 is adapted for driving the piezoelectric hammer 42 vigorously and instantaneously contacting with the negative terminal 341 so as to generate a relatively high voltage between the ignition tip 301 of the lead wire 41 and the gas ejection tip 131 of the lighter 10 to which the piezoelectric unit 20 equipped therewith, as shown in FIGS. 1 and 2, so that the striking sparks are generated from the igniting tip 301 and jumped to the gas ejection tip 131 for igniting the gas ejected therefrom.

Generally, the actuation means 60 comprises a resilient element 61, such as a compression spring as shown in FIG. 2, mounted between the top head 211 and the piezoelectric hammer 42 inside the receiving cavity 212 of the operating member 21, a pair of L-shaped guider slots 62 formed on two opposite side walls of the actuation body 222, a pair of operating slots 63 formed on two opposite side walls of the operating member 21 that are arranged to be overlapped with the pair of guider slots 62, and a stopper rod 64 radially affixed through the piezoelectric hammer 42 in such a manner that two ends of the stopper rod 64 are respectively extended through the two operating slots 63 and supporting at the two guider slots 62. Each of the guider slot 62 has a lateral portion 621 and a longitudinal portion 622. Each of the operating slot 63 has an upper slant side 631 and a lower slant side 632.

Figure 4:
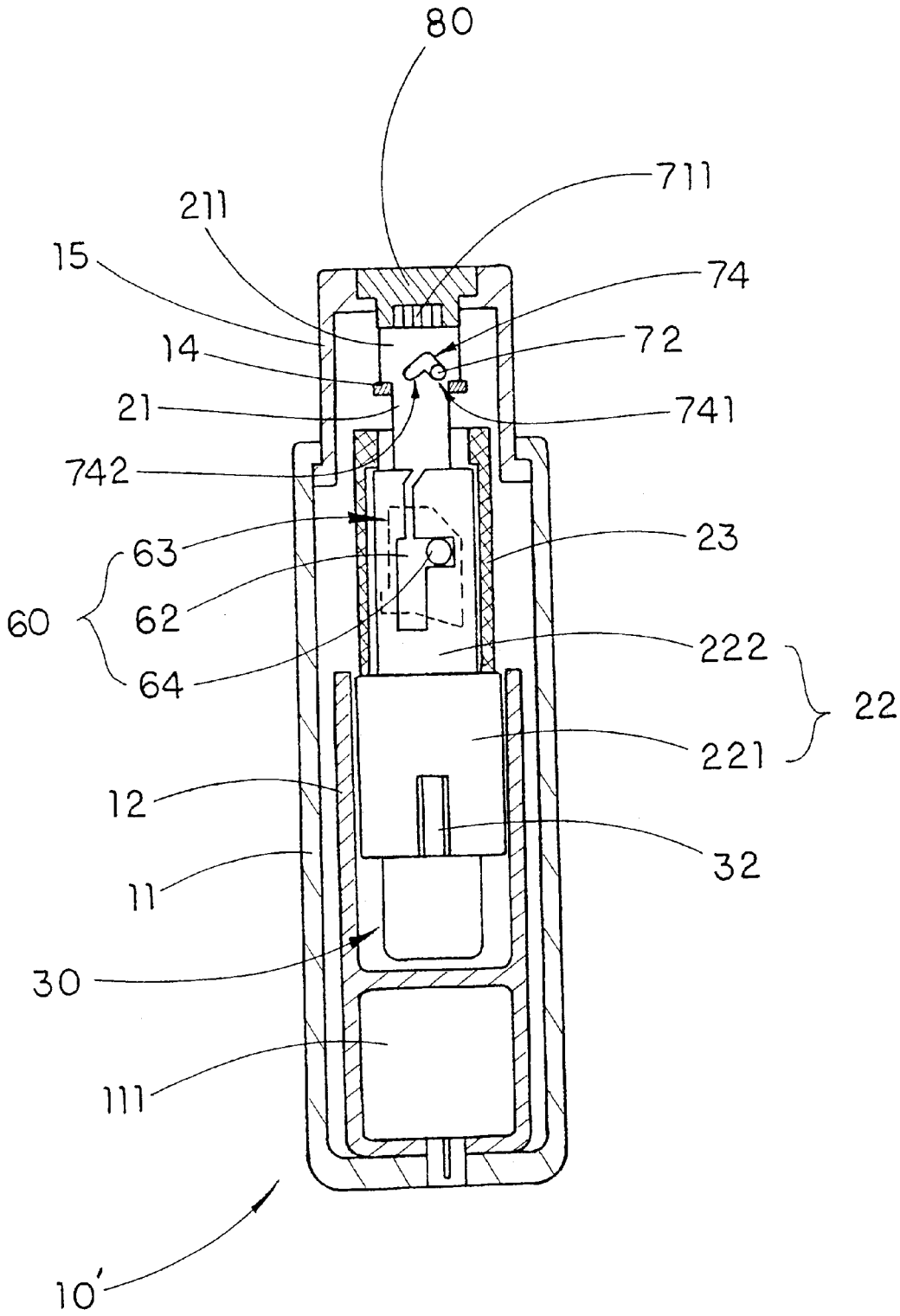
FIG. 4 is a partially sectional view of the piezoelectric unit equipped with a piezoelectric lighter according to the above preferred embodiment of the present invention.
Figure 5:
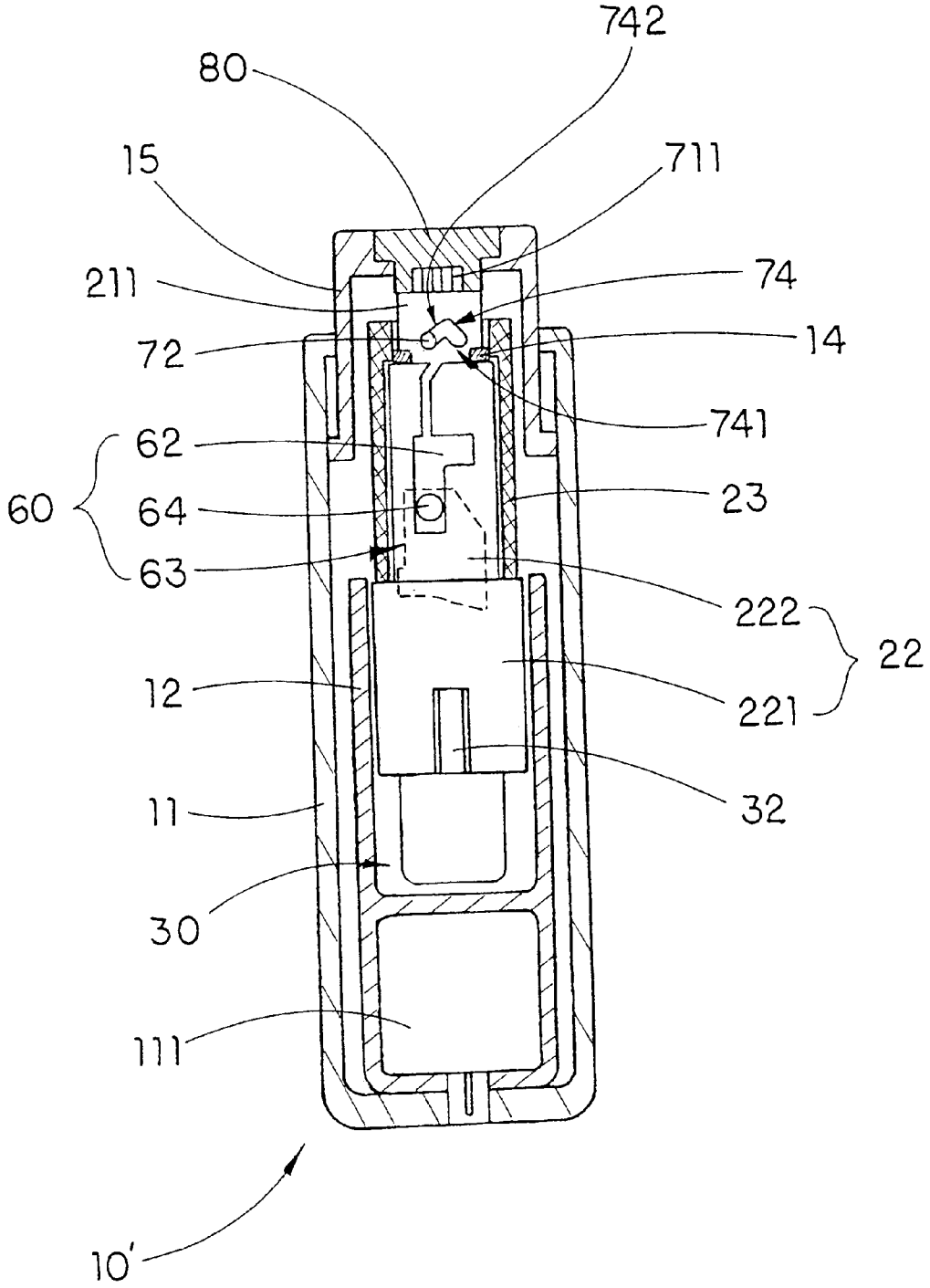
FIG. 5 is another partially sectional view of the piezoelectric unit equipped with the piezoelectric lighter, wherein piezoelectric unit is operated for ignition, according to the above preferred embodiment of the present invention.

Please referencing to FIGS. 4 and 5, during normal condition, the supporting spring 51 and the resilient element 61 support the piezoelectric hammer 42 therebetween, wherein the two ends of the stopper rod 64 are respectively retained to positioned at lower ends of the lower slant sides 632 of the operating slots 63 of the operating member 21 and the lateral portions 621 of the guider slots 62 of the actuation body 222, as shown in FIG. 4. When the top head 211 of the operating member 21 is pressed down, both the spring 51 and the resilient element 61 are both compressed until two ends of the stopper rod 64 are traveled up to the lower ends of the upper slant sides 631 of the operating slots 63 respectively. Since the piezoelectric hammer 42 is stopped by the lateral portions 621 of the guider slots 62, the downward movement of the operating member 21 will form a spacing displacement between the piezoelectric hammer 42 and the negative terminal 341 of the strike pin 34.

When the operating member 21 is continuously pressed downwardly, the stopper rod 64 will be driven and guided by the upper slant sides 631 of the operating member 21 to move left (as embodied and illustrated in FIGS. 4 and 5) until it is aligned with the two longitudinal portions 622 of the guider slot 62. At this moment, as shown in FIG. 5, the compressed resilient element 61 will drive the piezoelectric hammer 42 to vigorously and instantaneously strike on the negative terminal 341 of the strike pin 34 so as to generate a relatively high voltage between the ignition tip 301 of the lead wire 41 and the gas ejection tip 131 (as shown in FIG. 1), so that striking sparks are generated from the ignition tip 301 and jumped to the gas ejection tip 13 to ignite the gas emitted therefrom.

When the downward pressure applied on the top head 211 of the operating member 21 is released, the compressed spring 51 as well as the resilient element 61 will upwardly push the piezoelectric hammer 42 to its normal position and reject the operating member 21 to its upper position, as shown in FIG. 4.

Basically, the piezoelectric unit 20 is the heart of a piezoelectric lighter 10 for controlling the ejection and ignition of the gas. Since most of the piezoelectric lighters work and function as described above, it is apparent that the different of various kinds of piezoelectric lighter merely focuses on different designs of the casing and different arrangements of the components. In other words, if a safety mechanism must be equipped with each piezoelectric lighter, every kind of piezoelectric lighter needs to have a specific kind of safety mechanism. The present invention suggests a reasonable solution by providing a safety arrangement in a piezoelectric unit which can be equipped with all kinds of lighter casing and arrangement. Moreover, the best way is to design a safety arrangement which is simple in structure and low in cost without changing the structure of the piezoelectric unit as described above.

Referring to FIGS. 3 to 8, a piezoelectric unit 20' built-in with a safety arrangement 70 is illustrated. Please referring FIG. 3 in view of FIG. 2, the piezoelectric unit 20' of the present invention basically has an identical structure of the conventional piezoelectric unit 20 as shown in FIG. 2. In other words, by having nearly the same manufacturing cost and procedures of the conventional piezoelectric unit 20 to equip a safety arrangement 70 can provide the piezoelectric unit 20' of the present invention.

Figure 8:
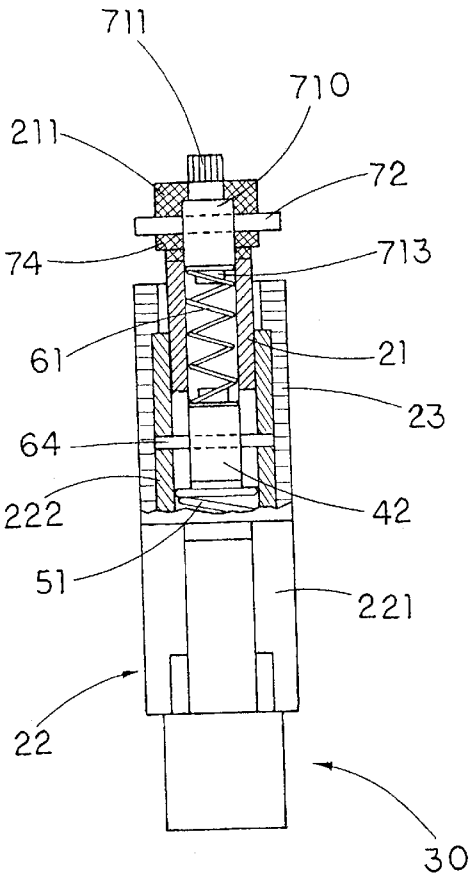
FIG. 8 is a partially sectional view of the piezoelectric unit with safety arrangement according to the above preferred embodiment of the present invention.

The safety arrangement 70 comprises a turner member 71 and a stopper pin 72. An operating opening 73 is formed on a top end of the top head 211 of the operating member 21 to coaxially communicate with the receiving cavity 212. The operating opening 73 is preferred to have a diameter smaller than the inner size of the receiving cavity 212 of the operating member 21. The turner member 71 comprises a cylindrical turner body 710, a turning head 711 upwardly extended from the turner body 710, a mounting hole 712 transversely extended through of the turner body 710, and a narrowed tail piece 713 downwardly extended from the turner body 710. The turner member 71 is rotatably disposed below the operating opening 73 inside operating member 21, wherein the tail piece 713 is engaged with a top end of the resilient element 61 and then the turning head 711 is upwardly pressed to penetrate out of the operating opening 73, as shown in FIGS. 4, 5 and 8.

At top portions of two opposite side walls of the operating member 21, a pair of guiding grooves 74 are provided thereon respectively. According to the preferred embodiment of the present invention, each of the guiding grooves 74 has a reversed V-shape to define a vertical portion 741 and an inclined portion 742 inclinedly and downwardly extended from a top end of the vertical portion 741.

As shown in FIGS. 3 and 6A–6C, the housing sleeve 23 further has a top portion 231 upwardly extended to a position higher than a height of the actuation body 22 and just below the two guiding grooves 74, so as to cover the operating member 21. On two opposite side walls of the housing sleeve 23, a pair of vertical operating slots 75 are respectively extended from a top end of the housing sleeve 23, wherein a top opening entrance 751 of each of the two operating slots 75 is aligned below a bottom end of the inclined portion 742 of the respective guiding groove 74, as shown in FIGS. 6 and 7.

The stopper pin 72 penetrates through the mounting hole 712 while two ends of the stopper pin 72 are respectively extended through and out of the two guiding grooves 74 respectively until they are positioned above two top edges of the two opposite side walls of the housing sleeve 23.

Figure 6C:
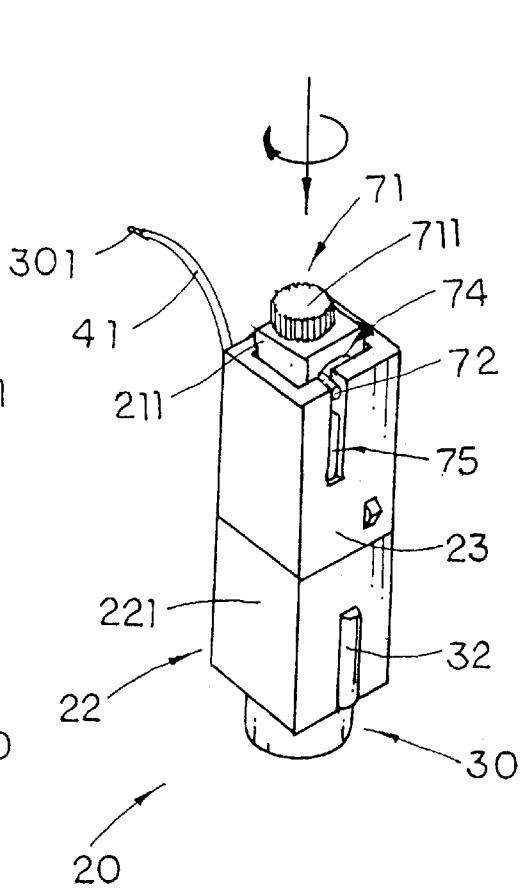
FIGS. 6A to 6C are perspective views of the piezoelectric unit, illustrating how it is operated to function, according to the above preferred embodiment of the present invention.
Figure 6B:
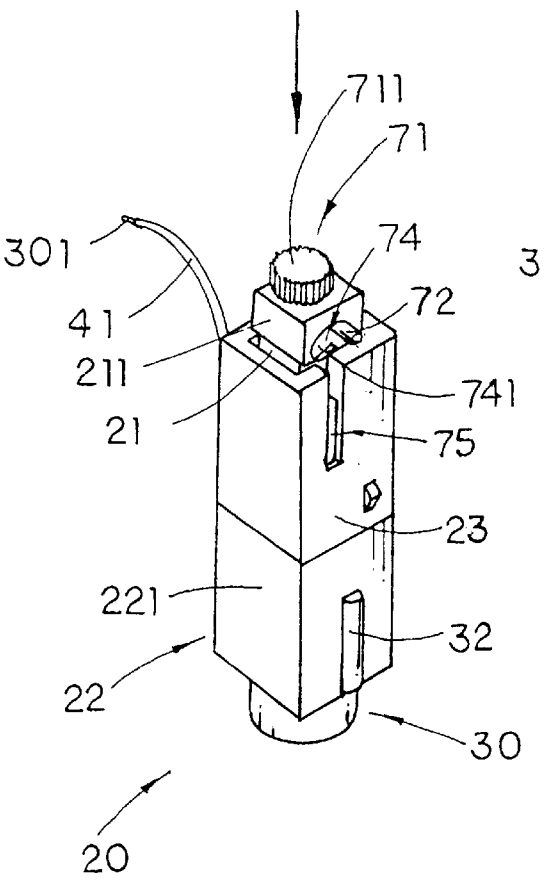
Figure 6A:
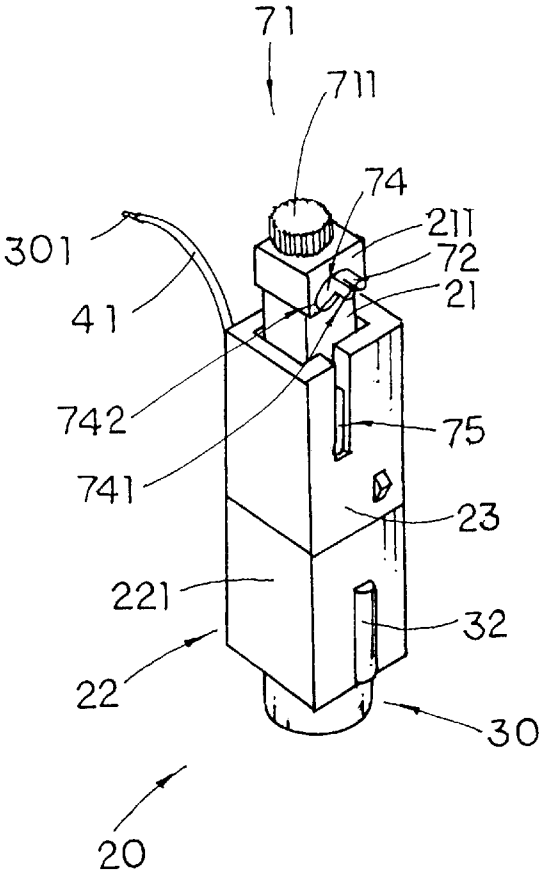

The operating opening 73 and the pair of guiding grooves 74 on the operating member 21 as well as the pair of vertical operating slots 75 on the housing sleeve 23 are additionally provided for incorporating with the turner member 71 and the stopper pin 72 so as to contribute the safety arrangement 70. As shown in FIGS. 6A to 6C, by means of the safety arrangement 70 equipped in the piezoelectric unit 20', the piezoelectric unit 20' itself can achieve a safety lock function.

As shown in FIG. 6B, when a user pushes down the operating member 21, the two ends of the stopper pin 72 will be blocked by the upwardly extended side walls of the housing sleeve 23 so that the downward movement of the operating member 21 is locked. When such a safety piezoelectric unit 20' is installed in a lighter 10' as illustrated in FIG. 4, the normal downwardly pushing of the thumb-push cap 15 will also be locked up to prevent unwanted ignition or a child to ignite the piezoelectric lighter 10'.

In order to operate the piezoelectric unit 20', as shown in FIG., 6C, the user must initially press down and turn the turning head 711 of the turner member 71 until the stopper pin 72 is driven to turn to a bottom end of the inclined portion 742 of the guiding groove 74 and aligned with the operating slots 75. Then, the user should maintain this position of the turner member 71 and continuously press down the operating member 21 to normally operate the piezoelectric unit 20' to generate striking sparks from the ignition tip 301. When the pressing force applied to the operating member 21 is released, the spring 51 and the resilient element 61 would upwardly re-bounce the operating member 21 to its original upper position. At the same time, the resilient element 61 will also drive the turner member 71 to turn in opposite direction back to the locking condition as shown in FIG. 6A.

Figure 3:
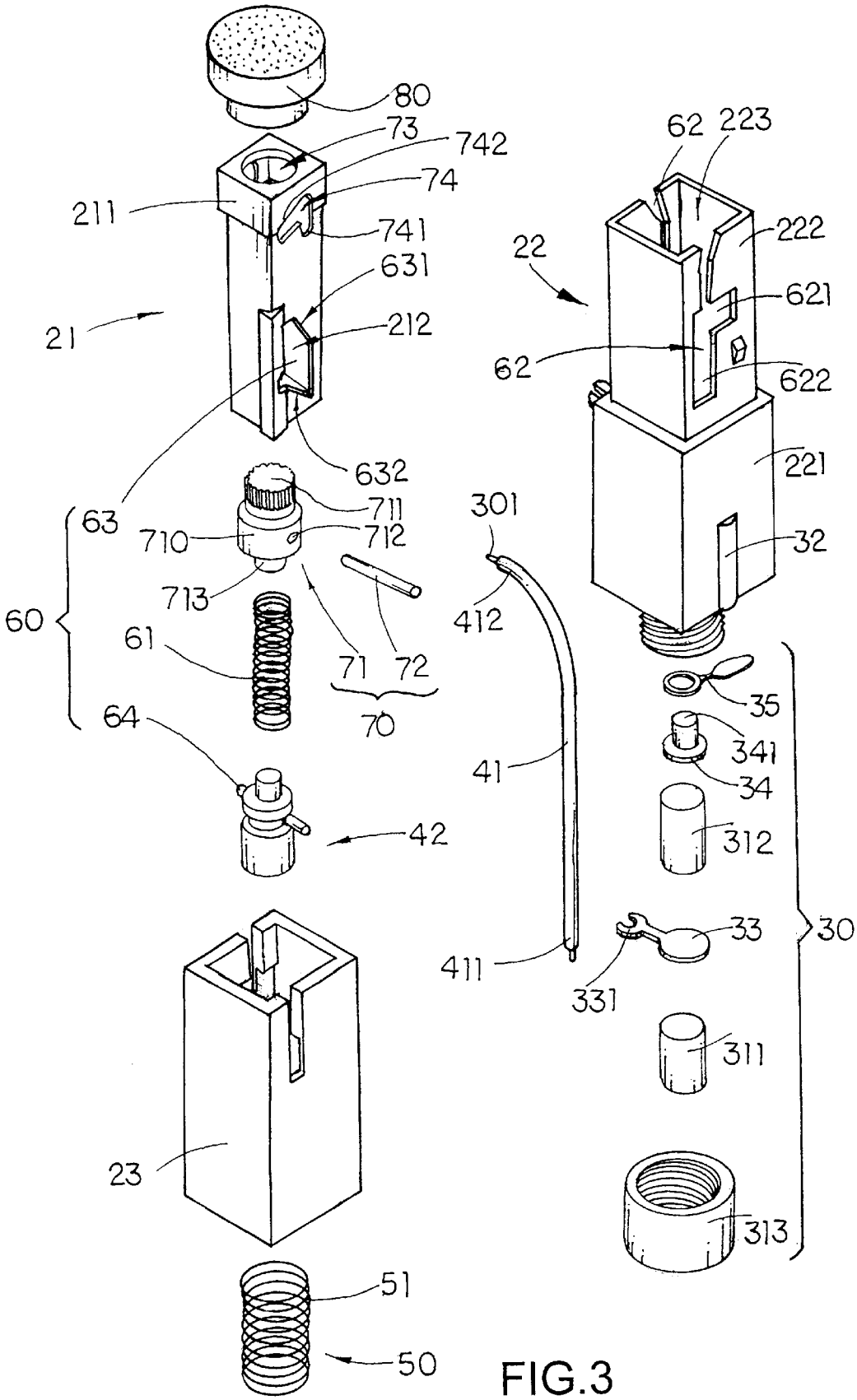
FIG. 3 is an exploded perspective view of a piezoelectric unit with safety arrangement according to a preferred embodiment of the present invention.

It is worth to mention that, the turning direction of the turning head 711 may be clockwise or anticlockwise, dependent the inclining direction of the inclined portion 742 of the guiding groove 74. According to the preferred embodiment, as shown in FIGS. 3 and 6, since the inclined portion 742 of the guiding groove 74 is inclined to the left, the turning direction of the turning head 711 should be clockwise. Of course, it is apparent that if the inclined portion 742 of the guiding groove 74 is inclined to the right, the turning direction of the turning head 711 will become anticlockwise.

If the lighter manufacturers or designers consider the turning head 711 is relatively small for operation, an enlarged turner button 80 can be engaged with the turning head 711 of the turner member 71, as shown in FIGS. 3, 4 and 5. The turner button 80 is disposed on the thumb-push cap 15 so that an adult user can simultaneously press the thumb-push cap 15 and turn the turner button 80. However, to a child under 5 years old, it is nearly impossible for him or her to use his or her small finger to operate the thumb-push cap 15 and the turner head 711 or the turner button 80 at the same time. Moreover, when a child can substantially push down the thumb-push cap 15 but the piezoelectric lighter 10' fails to be ignited, the child would think that the lighter is out of order and stop playing with it.

Figure 7A:
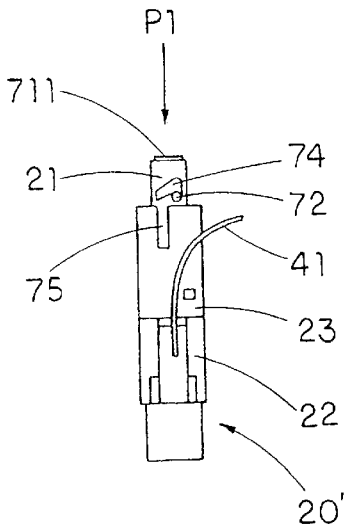
FIGS. 7A to 7F are side views of the piezoelectric unit, illustrating a sequence of operation thereof, according to the above preferred embodiment of the present invention.
Figure 7B:
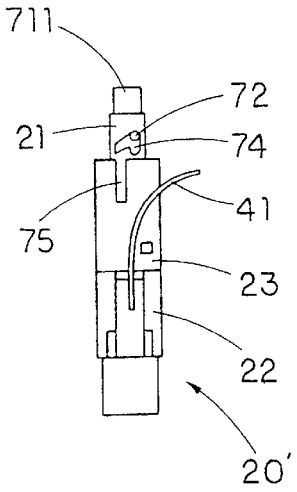

FIG. 7A demonstrates that a simple downward pushing force P1 can only press down the turning head 711 of the turner member 71 to drive the stopper pin 72 simply traveling from an upper end to a bottom end of the vertical portion 741 of the guiding groove 74. The piezoelectric unit 20' can not be rightfully operated. When the pushing force P1 is released, the piezoelectric unit 20' automatically returns to its original locking condition.

Figure 7C:
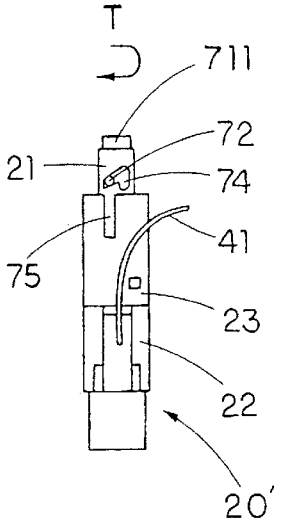
Figure 7D:
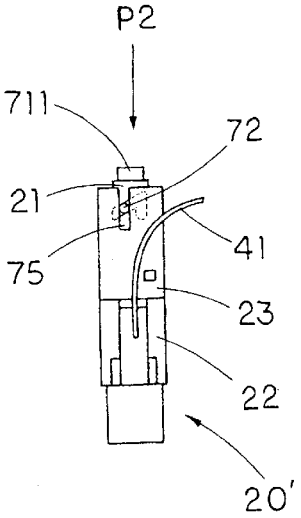

FIG. 7C demonstrates that when a turning force T is applied to rotate the turning head 711 of the turner member 71, the stopper pin 72 is driven to a bottom end of the inclined portion 742 of the guiding groove 74 and aligned with the operating slot 75, so that a downward pressing force P2, as shown in FIG. 7D, can substantially operate the piezoelectric unit 20' to press down the operating member 21.

Figure 7E:
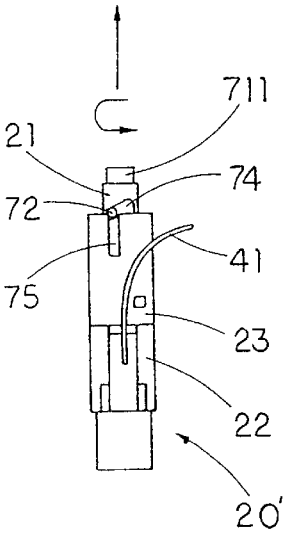
Figure 7F:
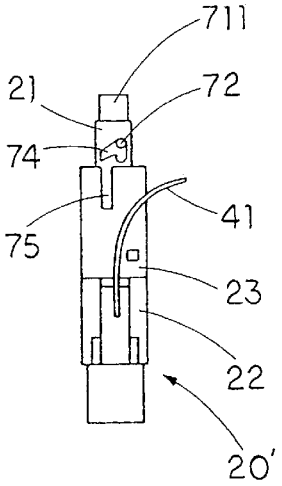

FIGS. 7E and 7F demonstrate that when the pressing force P2 is released, the operating member 21 will automatically be driven to move upwards (as shown in FIG. 7E) and return to its original locking position (as shown in FIG. 7F) upon the stopper pin 75 upwardly traveled above the operating slot 75. It is worth to mention that when a reversed V-shape operating slot 75 is embodied, the housing sleeve 23 can reduce its height so as to omit the presence of the operating slots 75.

Please be notified that the present invention successfully takes the advantages of the original structure of the piezoelectric unit and substantially utilizes as less parts as possible to construct a safety arrangement for enabling a piezoelectric unit to perform a safety lock feature. In fact, only a turner member 71 with a stopper pin 72 are added to the conventional piezoelectric unit. By utilizing the resilient force provided by the resilient element 61 of the conventional piezoelectric unit 20 and additionally providing the operating opening 73, the pair of guiding groove 74 and the pair of operating slots 75 on the housing sleeve 23, the piezoelectric unit is adapted to become a safety mechanism.

Figure 9:
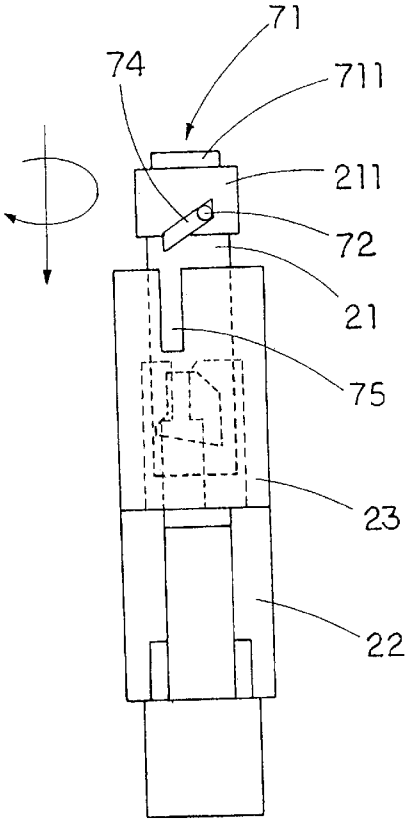
FIG. 9 is a side view of a first alternative mode of the piezoelectric unit with safety arrangement according to the above preferred embodiment of the present invention.

As shown in FIG. 9, a first alternative mode of the piezoelectric unit according to the above preferred embodiment of the present invention is illustrated, wherein the vertical portion 741 of each of the guiding groove 74 is eliminated, so that the turner member 71 becomes unable to press down unless the user turns it first.

Figure 10:
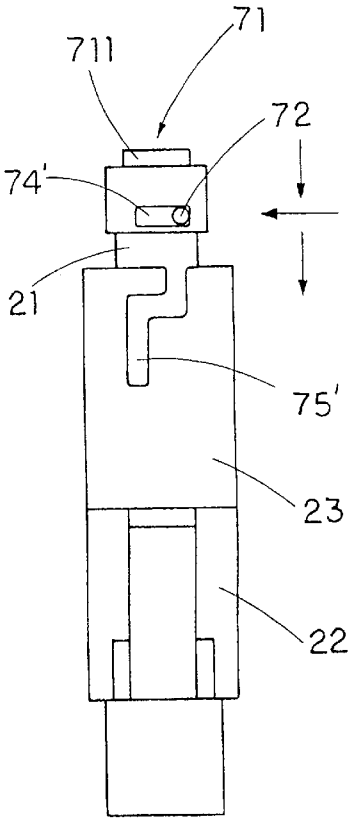
FIG. 10 is a side view of a second alternative mode of the piezoelectric unit with safety arrangement according to the above preferred embodiment of the present invention.

As shown in FIG. 10, a second alternative mode of the piezoelectric unit according to the above preferred embodiment of the present invention is illustrated, wherein a pair of horizontal extended guiding grooves 74' substitute the reversed V-shaped guiding grooves 74, and that the vertical operating slots 75 are substituted by a pair of S-shaped operating slots 75'. To operate this alternative mode, the user must first press down the operating member 21 until the stopper pin 72 downwardly moves into the operating slots 75'. And then, the user should rotate the turner member 71 until the stopper pin 72 moves to align with a lower portion of the operating slot 75', so that the operating member 21 can thus be further push down to normally operate and produce striking sparks.

Figure 11:
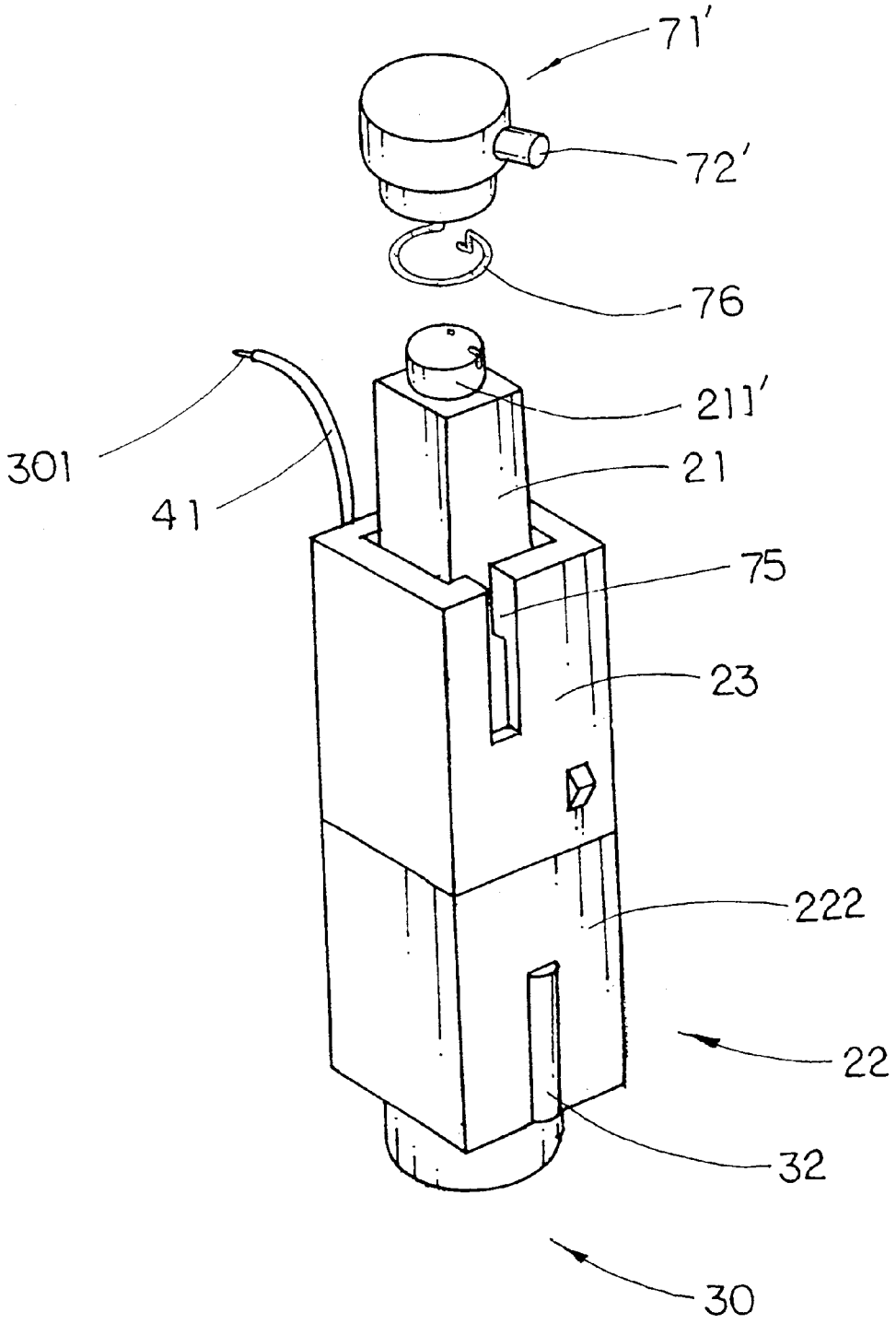
FIG. 11 is a partially exploded perspective view of a third alterative mode of the piezoelectric unit with safety arrangement according to the above preferred embodiment of the present invention.

As shown in FIG. 11, a third alternative mode of the piezoelectric unit according to the above preferred embodiment of the present invention is illustrated, wherein the turner member 71 is substituted by an enlarged turner member 71 ' which has a stopper pin 72' penetrated therethrough. The cap like turner member 71' is rotatably mount on a rod shaped top head 211' of the operating member 21. A C-shaped spring 76 is mounted between the top head 211' and the turner member 71'. In order to operate this third alternative mode, the user must first rotate the turner member 71' until the stopper pin 72' is aligned with the operating slot 75. Then, the user should maintain the turning position of the turner member 71' and press down the operating member 21 to normally operate and produce striking sparks.

Figure 12:
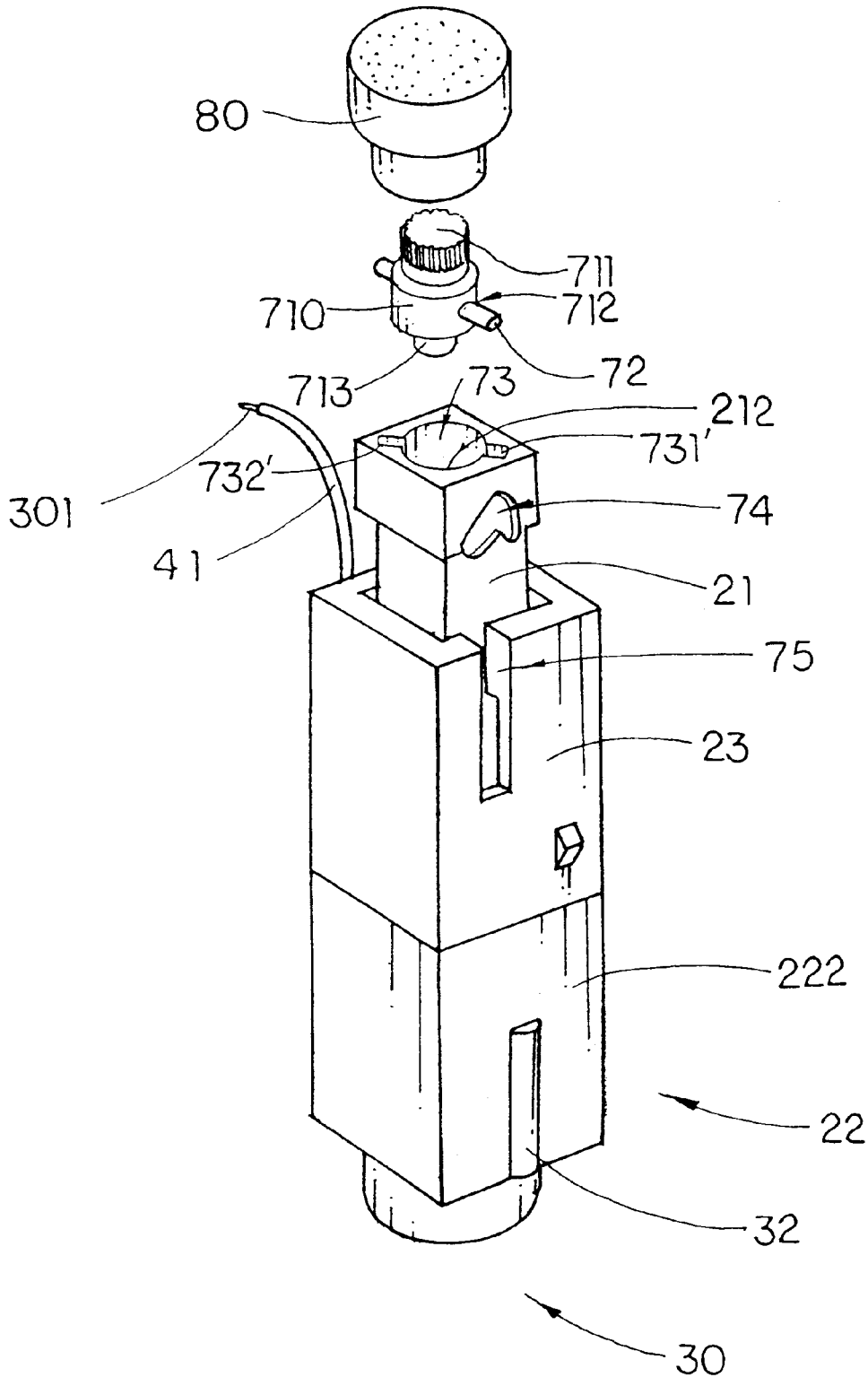
FIG. 12 is a partially exploded perspective view of a fourth alternative mode of the piezoelectric unit with safety arrangement according to the above preferred embodiment of the present invention.

As shown in FIG. 12, a fourth alternative mode of the piezoelectric unit according to the above preferred embodiment of the present invention is illustrated, wherein the stopper pin 72 is connected with the mounting hole 712 before placing into the receiving cavity 212.

Correspondingly, the operating opening 73' has a diameter slightly larger than the turner body 710 and two pin slots 731', 732' provided at two opposite sides of the operating opening 73', so that the turner member 71 ' can be directly inserted into the receiving cavity 212 via the operating opening 73 wherein the two ends of the stopper pin 72 can be inserted through the two pin slots 731', 732' into the receiving cavity 212 and slid to rest in the guiding groove 74.

Figure 13:
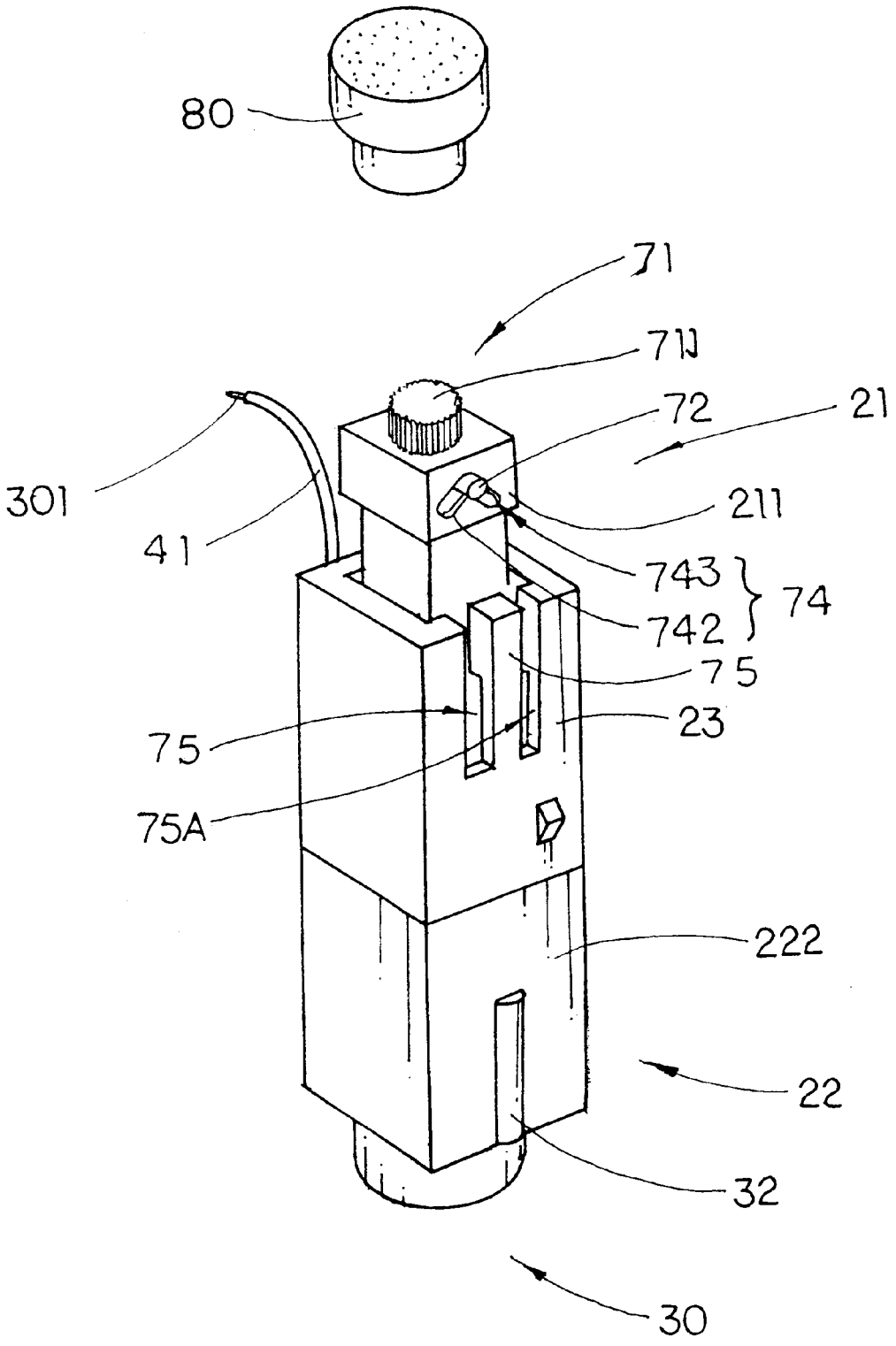
FIG. 13 is a perspective view of a fifth alternative mode of the piezoelectric unit according to the above preferred embodiment of the present invention.

As shown in FIG. 13, a fifth alternative mode of the piezoelectric unit according to the above preferred embodiment of the present invention, wherein the vertical portion of each of the guiding grooves 74 of the above preferred embodiment is substitute by a second inclined portion 743 which joins with the first inclined portion 742 at the tip ends thereof to formed a guiding groove 74" in reversed V shaped as shown in FIG. 13. Correspondingly, an additional pair of vertical operating slots 75A are extended downwardly parallel with the first pair of operating slots 75 respectively, wherein the second pair of operating slots 75A are aligned with the bottom ends of the pair of second inclined portions 743 of the pair of guiding grooves 74" respectively. Accordingly, the turner member 71 can be turned in both clockwise and anticlockwise direction in order to unlock and operate the piezoelectric unit of the present invention. A simply downward pushing of the operating member 21 and the turning head 711 will be blocked by the top edge of the housing sleeve 23, however, either a clockwise or an anticlockwise turning of the turner button 80, i.e. the turning head 71, can respectively drive the stopper pin 72 to the slide sidewardly and downwardly into the first inclined portion 742 or the second inclined portion 743 of the guiding groove 74" to respectively align with the first operating slot 75 or the second operating slot 75A.

In view of the disclosure above, the present invention can substantially achieve plenty of advantages as follows:

1. The safety arrangement is built-in in the piezoelectric unit so that it is adapted to equipped with all kinds of piezoelectric lighter so as to provide a safety lock feature for the piezoelectric lighter.

2. When the safety piezoelectric unit equip with a piezoelectric lighter, the piezoelectric lighter not only can prevent the minor, especially under 5 years old, to ignite the lighter so as to guarantee the safety of children, but also can normally lock up the piezoelectric unit to prevent the piezoelectric lighter from being accidentally or unintentionally ignited by the adults.

3. The safety arrangement of the piezoelectric unit can automatically return to a locking condition after each ignition operation, so as to prevent any lighting operation of the piezoelectric unit by locking up the downward movement of the pusher cap.

4. It does not require to alter the original structural design of the piezoelectric lighter, so as to minimize the manufacturing cost of improving every conventional piezoelectric lighter to have safety feature.

What is claimed is:

1. A piezoelectric unit, comprising:

a piezoelectric housing having a lower base body and an upper actuation chamber;

an operating member having an axial receiving cavity provided therein and being slidably fitted in said actuation chamber of said piezoelectric housing in a vertically movable manner;

a high voltage generating means which is arranged in said base body for generating striking sparks at an ignition tip thereof when said operating member disposed in said actuation chamber is pressed downwardly towards said base body; and a safety arrangement which is arranged in said operating member for normally locking a downward movement of said operating member unless a turner member is operated with said downward movement of said operating member.

2. A piezoelectric unit, as recited in claim 1, wherein said safety arrangement further comprises a stopper pin radially extended from said turner member which is rotatably coupled with a top head of said operating member in such a manner that when said operating member is pressed downwards, said stopper pin is blocked by a top edge of a housing sleeve enclosing said actuation body of said piezoelectric housing, unless said turner member is rotated until said stopper pin is aligned with of at lease one operating slot downwardly extended from said top edge of said housing sleeve.

3. A piezoelectric unit, as recited in claim 1, wherein an operating opening is formed on a top end of said top head of said operating member to coaxially communicate with said receiving cavity, said turner member comprising a turning head upwardly extended from said turner body and a narrowed tail piece downwardly extended from said turner body, said turner member being rotatably disposed below said operating opening inside operating member, said tail piece of said turner member being engaged with a resilient element disposed under said turner member inside said receiving chamber of said operating member, said turning head being upwardly pressed by said resilient element to penetrate out of said operating opening, said safety arrangement further comprising a stopper pin radically penetrating through said turner member, at top portions of two opposite side walls of said operating member, a pair of guiding grooves being provided thereon respectively, wherein each of said guiding grooves has a vertical portion and an inclined portion inclinedly and downwardly extended from a top end of said vertical portion, wherein said stopper pin penetrates through said mounting hole while two ends of said stopper pin are respectively extended through and out of said two guiding grooves respectively.

4. A piezoelectric unit, as recited in claim 3, wherein a housing sleeve, which is arranged to surround said actuation body, further has a top portion upwardly extended to a position higher than a height of said actuation body and just below said two guiding grooves, so as to cover said operating member, and that on two opposite side walls of said housing sleeve, a pair of vertical operating slots are respectively extended from a top end of said housing sleeve, wherein a top opening entrance of each of said two operating slots is aligned below a bottom end of said inclined portion of said respective guiding groove.

5. A piezoelectric unit, as recited in claim 2, wherein an operating opening is formed on a top end of said top head of said operating member to coaxially communicate with said receiving cavity, said turner member comprising a turning head upwardly extended from said turner body and a narrowed tail piece downwardly extended from said turner body, said turner member being rotatably disposed below said operating opening inside operating member, said tail piece of said turner member being engaged with a resilient element disposed under said turner member inside said receiving chamber of said operating member, said turning head being upwardly pressed by said resilient element to penetrate out of said operating opening, said safety arrangement further comprising a stopper pin radially penetrating through said turner member, at top portions of two opposite side walls of said operating member, a pair of guiding grooves being provided thereon respectively, wherein said stopper pin penetrates through said mounting hole while two ends of said stopper pin are respectively extended through and out of said two guiding grooves respectively, wherein said top edge of said housing sleeve is upwardly extended to a position higher than a height of said actuation body and just below said two guiding grooves, so as to cover said operating member, and that on two opposite side walls of said housing sleeve, a pair of vertical operating slots are respectively extended from a top end of said housing sleeve, wherein a top opening entrance of each of said two operating slots is aligned below a bottom end of said inclined portion of said respective guiding groove.

6. A piezoelectric unit, as recited in claim 5, wherein each of said guiding grooves is inclinedly extended downwardly.

7. A piezoelectric unit, as recited in claim 5, wherein each of said guiding groove is horizontally extended.

8. A piezoelectric unit, as recited in claim 2, wherein said turner member is rotatably mount on said top head of said operating member, and a C-shaped spring is mounted between said top head and said turner member.

9. A piezoelectric unit, as recited in claim 1, adapted for equipping in a lighter, wherein said high voltage generating means comprises:

at least one piezoelectric ceramic, which is received in said base body, providing a positive terminal and a negative terminal extended to a bottom end of said actuation chamber;

a lead wire having one end connected to said positive terminal and forming an ignition tip at another end of said lead wire;

a piezoelectric hammer disposed in said receiving cavity of said operating member in a vertically movable manner;

a supporting means for normally supporting said operating member and said piezoelectric hammer in a normal position that a distance is retained between said piezoelectric hammer and said negative terminal; and an actuation means for driving said piezoelectric hammer vigorously and instantaneously striking on said negative terminal so as to generate a high voltage between said ignition tip of said lead wire and a gas ejection tip of said lighter, so that said striking sparks are generated from said igniting tip and jumped to said gas ejection tip, wherein said actuation means comprises a resilient element mounted between said top head and said piezoelectric hammer inside said receiving cavity of said operating member;

wherein an operating opening is formed on a top end of said top head of said operating member to coaxially communicate with said receiving cavity, said turner member comprising a turning head upwardly extended from said turner body and a narrowed tail piece downwardly extended from said turner body for engaging with a top end of said resilient element, said turner member being rotatably disposed below said operating opening inside operating member and said turning head being upwardly pressed by said resilient element to penetrate out of said operating opening, said safety arrangement further comprising a stopper pin radically penetrating through said turner member, at top portions of two opposite side walls of said operating member, a pair of guiding grooves being provided thereon respectively, wherein each of said guiding grooves has a reversed V-shape to define a vertical portion and an inclined portion inclinedly and downwardly extended from a top end of said vertical portion, wherein said stopper pin penetrates through said mounting hole while two ends of said stopper pin are respectively extended through and out of said two guiding grooves respectively.

10. A piezoelectric unit, as recited in claim 9, wherein a housing sleeve, which is arranged to surround said actuation body, further has a top portion upwardly extended to a position higher than a height of said actuation body and just below said two guiding grooves, so as to cover said operating member, and that on two opposite side walls of said housing sleeve, a pair of vertical operating slots are respectively extended from a top end of said housing sleeve, wherein a top opening entrance of each of said two operating slots is aligned below a bottom end of said inclined portion of said respective guiding groove.

11. A piezoelectric unit, as recited in claim 2, adapted for equipping in a lighter, wherein said high voltage generating means comprises:

at least one piezoelectric ceramic, which is received in said base body, providing a positive terminal and a negative terminal extended to a bottom end of said actuation chamber, a lead wire having one end connected to said positive terminal and forming an ignition tip at another end of said lead wire;

a piezoelectric hammer disposed in said receiving cavity of said operating member in a vertically movable manner;

a supporting means for normally supporting said operating member and said piezoelectric hammer in a normal position that a distance is retained between said piezoelectric hammer and said negative terminal; and an actuation means for driving said piezoelectric hammer vigorously and instantaneously striking on said negative terminal so as to generate a high voltage between said ignition tip of said lead wire and a gas ejection tip of said lighter, so that said striking sparks are generated from said igniting tip and jumped to said gas ejection tip, wherein said actuation means comprises a resilient element mounted between said top head and said piezoelectric hammer inside said receiving cavity of said operating member;

wherein an operating opening is formed on a top end of said top head of said operating member to coaxially communicate with said receiving cavity, said turner member comprising a turning head upwardly extended from said turner body and a narrowed tail piece downwardly extended from said turner body for engaging with a top end of said resilient element, said turner member being rotatably disposed below said operating opening inside operating member and said turning head being upwardly pressed by said resilient element to penetrate out of said operating opening, said safety arrangement further comprising a stopper pin radically penetrating through said turner member, at top portions of two opposite side walls of said operating member, a pair of guiding grooves being provided thereon respectively, wherein said stopper pin penetrates through said mounting hole while two ends of said stopper pin are respectively extended through and out of said two guiding grooves respectively, wherein said top edge of said housing sleeve is upwardly extended to a position higher than a height of said actuation body and just below said two guiding grooves, so as to cover said operating member, and that on two opposite side walls of said housing sleeve, a pair of vertical operating slots are respectively extended from a top end of said housing sleeve, wherein a top opening entrance of each of said two operating slots is aligned below a bottom end of said inclined portion of said respective guiding groove.

12. A piezoelectric unit, as recited in claim 11, wherein each of said guiding grooves is inclinedly extended downwardly.

13. A piezoelectric unit, as recited in claim 11, wherein each of said guiding groove is horizontally extended.

14. A piezoelectric unit, as recited in claim 3, wherein said safety arrangement further comprises an enlarged turner button which is engaged with said turning head of said turner member.

15. A piezoelectric unit, as recited in claim 5, wherein said safety arrangement further comprises an enlarged turner button which is engaged with said turning head of said turner member.

16. A piezoelectric unit, as recited in claim 9, wherein said safety arrangement further comprises an enlarged turner button which is engaged with said turning head of said turner member, said turner button is adapted to dispose on a thumb-push cap of said lighter.

17. A piezoelectric unit, as recited in claim 11, wherein said safety arrangement further comprises an enlarged turner button which is engaged with said turning head of said turner member, said turner button is adapted to dispose on a thumb-push cap of said lighter.

18. A piezoelectric unit, as recited in claim 1, wherein an operating opening is formed on a top end of said top head of said operating member to coaxially communicate with said receiving cavity, said turner member comprising a turning head upwardly extended from said turner body and a narrowed tail piece downwardly extended from said turner body, said turner member being rotatably disposed below said operating opening inside operating member, said tail piece of said turner member being engaged with a resilient element disposed under said turner member inside said receiving chamber of said operating member, said turning head being upwardly pressed by said resilient element to penetrate out of said operating opening, said safety arrangement further comprising a stopper pin radially penetrating through said turner member, at top portions of two opposite side walls of said operating member, a pair of guiding grooves being provided thereon respectively, wherein each of said guiding grooves has a reversed V shape to define a first inclined portion inclined downwardly and leftwardly and a second inclined portion inclined downwardly and rightwardly from top ends thereof, therein said stopper pin penetrates through said mounting hole while two ends of said stopper pin are respectively extended through and out of said two guiding grooves respectively.

19. A piezoelectric unit, as recited in claim 18, wherein a housing sleeve, which is arranged to surround said actuation body, further has a top portion upwardly extended to a position higher than a height of said actuation body and just below said two guiding grooves, so as to cover said operating member, and that on two opposite side walls of said housing sleeve, a first and a second pair of vertical operating slots are respectively extended from a top end of said housing sleeve, wherein a top opening entrance of each of said first pair of operating slots is aligned below a bottom end of said first inclined portion of said respective guiding groove, and said second pair of operating slots are downwardly extended in parallel with said first pair of operating slots respectively on said two opposite side walls of said housing sleeve, so as to align below bottom ends of said second inclined portions of said guiding grooves respectively.

20. A piezoelectric unit, as recited in claim 4, wherein said operating opening has a diameter equal to or slightly larger than said turner body and two pin slots are provided at two opposite sides of said operating opening, wherein said turner member is capable of directly inserting into said receiving cavity via said operating opening while said two ends of said stopper pin inserting through the two pin slots into said receiving cavity and sliding to rest in said guiding groove.

21. A piezoelectric unit, as recited in claim 5, wherein said operating opening has a diameter equal to or slightly larger than said turner body and two pin slots are provided at two opposite sides of said operating opening, wherein said turner member is capable of directly inserting into said receiving cavity via said operating opening while said two ends of said stopper pin inserting through the two pin slots into said receiving cavity and sliding to rest in said guiding groove.

22. A piezoelectric unit, as recited in claim 9, wherein said operating opening has a diameter equal to or slightly larger than said turner body and two pin slots are provided at two opposite sides of said operating opening, wherein said turner member is capable of directly inserting into said receiving cavity via said operating opening while said two ends of said stopper pin inserting through the two pin slots into said receiving cavity and sliding to rest in said guiding groove.

23. A piezoelectric unit, as recited in claim 11, wherein said operating opening has a diameter equal to or slightly larger than said turner body and two pin slots are provided at two opposite sides of said operating opening, wherein said turner member is capable of directly inserting into said receiving cavity via said operating opening while said two ends of said stopper pin inserting through the two pin slots into said receiving cavity and sliding to rest in said guiding groove.

24. A piezoelectric unit, as recited in claim 19, wherein said operating opening has a diameter equal to or slightly larger than said turner body and two pin slots are provided at two opposite sides of said operating opening, wherein said turner member is capable of directly inserting into said receiving cavity via said operating opening while said two ends of said stopper pin inserting through the two pin slots into said receiving cavity and sliding to rest in said guiding groove.

* * * * *